US007665582B2

(12) United States Patent
Lindh

(10) Patent No.: US 7,665,582 B2
(45) Date of Patent: Feb. 23, 2010

(54) ELEVATOR CAR WITH A WORKING PLATFORM

(75) Inventor: Mikael Lindh, Skellefteå (SE)

(73) Assignee: Alimak AB, Skelleftea (SE)

( * ) Notice: Subject to any disclaimer, the term of this patent is extended or adjusted under 35 U.S.C. 154(b) by 371 days.

(21) Appl. No.: 10/592,049

(22) PCT Filed: Mar. 10, 2005

(86) PCT No.: PCT/SE2005/000343

§ 371 (c)(1),
(2), (4) Date: Sep. 8, 2006

(87) PCT Pub. No.: WO2005/087645

PCT Pub. Date: Sep. 22, 2005

(65) Prior Publication Data

US 2007/0271863 A1 Nov. 29, 2007

(30) Foreign Application Priority Data

Mar. 12, 2004 (SE) ..... 0400637

(51) Int. Cl.
*B66B 7/00* (2006.01)
*B66B 11/02* (2006.01)
*E04G 3/00* (2006.01)

(52) U.S. Cl. ..... 187/401; 187/414; 182/2.1; 182/2.2; 182/2.3

(58) Field of Classification Search ..... 187/239–241, 187/244, 401, 270, 406, 414; 52/111, 115; 182/131, 130, 2.1–2.3, 2.6–2.8, 148, 63.1, 182/113; 212/180, 192
See application file for complete search history.

(56) References Cited

U.S. PATENT DOCUMENTS 2,535,112 A * 12/1950 Woody ..... 312/233
2,646,182 A * 7/1953 Maas ..... 414/637
4,326,601 A * 4/1982 Grove et al. ..... 182/2.11
4,809,814 A 3/1989 St-Germain
5,497,851 A * 3/1996 Walcher et al. ..... 182/223

(Continued)

FOREIGN PATENT DOCUMENTS

CH 6887151 A5 9/1996

(Continued)

OTHER PUBLICATIONS

International Search Report of PCT/SE 2005/000343 mailed May 26, 2005.

*Primary Examiner*—John Q Nguyen
*Assistant Examiner*—Stefan Kruer
(74) *Attorney, Agent, or Firm*—Nixon & Vanderhye P.C.

(57) ABSTRACT

The invention concerns an elevator system comprising an elevator car with a working platform arranged for carrying people or materials and which by means of the interaction between a gear wheel and gear rack can be moved along an elongated generally vertical mast constructed from a number of mast sections mounted on top of each other. To facilitate the erection, tearing down and anchoring of the mast to a nearby building structure, the moving unit comprises a passenger-carrying service and assembly platform, which, via a swing arm, is flexibly supported by the elevator car to allow a swivel action in a horizontal plane (C, D) relative to the elevator car.

17 Claims, 7 Drawing Sheets

Figure 1:
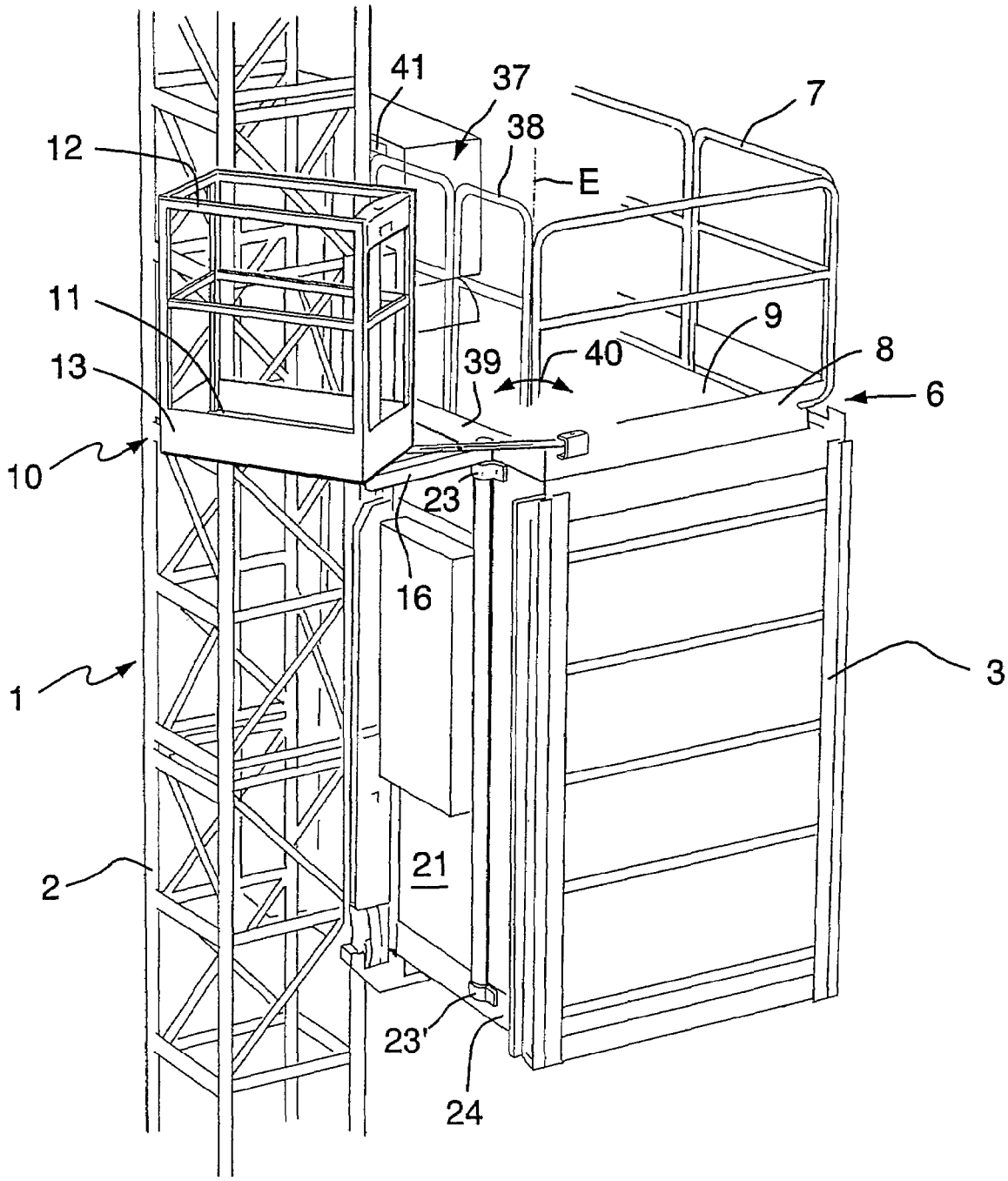

U.S. PATENT DOCUMENTS 5,699,878 A * 12/1997 Oury et al. ..... 187/234
5,868,218 A * 2/1999 Lawson ..... 182/69.6
6,460,652 B1 * 10/2002 Piipponen ..... 182/2.9

FOREIGN PATENT DOCUMENTS

DE 3307658 A1 * 9/1984
EP 0649811 A2 4/1995
GB 2160174 A 12/1985

* cited by examiner

ELEVATOR CAR WITH A WORKING PLATFORM

This application is the US national phase of International application PCT/SE2005/000343, filed 10 Mar. 2005, which designated the U.S. and claims priority of SE 0400637-5, filed 12 Mar. 2004, the entire contents of each of which are hereby incorporated by reference.

The present invention concerns a lift system primarily comprising a vertical mast constructed of a number of inter-fitting sections and a lift car of cage or platform type that can be moved along the said constructed mast for the carriage of persons or goods.

Even though the aforesaid lift type can be used as a service lift in permanent installations, its particular range of uses is for erecting or renovating buildings, whereby the lift is constructed for temporary use. One essential advantage is hereby that the mast incorporated in the lift system can easily be adapted to the gradually increasing height of the building by extending it with new sections stacked and mounted on top of each other. The thus erected mast can be dismantled in a converse manner by disassembling the sections and transporting them down from the top of the mast by means of the lift car. In cases where the lift car is of cage type, the roof of the cage is normally used not just as a load bearing surface for the transport of mast sections to and from the top of the mast but also as a working platform for constructing the mast and for associated assembly work. To facilitate handling the relatively heavy mast sections between the lift car and the top of the mast, a type of crane arranged on the lift car is normally used. The inter-fitting mast sections are fastened to each other by means of removable connectors arranged at the adjoining upper and lower ends of the sections. The said connectors usually comprise conventional screw joints. One problem experienced with the assembly and disassembly of the sections is that the screw joints, which are positioned on the rear of the mast viewed from the lift car, usually have a limited accessibility from the lift car and personnel are often forced to climb out onto the mast in order to access these screw joints. Due to the extreme heights involved, it should be understood that assembly and disassembly of the sections are dangerous operations when working with these masts.

At regular intervals along its length, the section-built mast is braced to the adjoining building structure with anchors at certain points made from elongated stay elements. For anchoring, one end of the stay elements is fixed to the building structure and the other end to the mast. In the case of the erection of new buildings, the floor structures of the building can serve as a working platform when fixing the one end of the stay element that is to be anchored to the building structure. In cases where the building structure is completely smooth, such as on a chimney stack or the like, all assembly and anchoring work must normally be carried out directly from the lift car. The distance between the lift car and the building structure in most cases is too great for this work to be carried out in a safe and ergonomically correct manner.

On a building site, the work of erecting and tearing down the said masts is among the heaviest and most risky tasks that can be performed. Since this type of lift is constantly being erected, torn down and moved, there is a desire to improve and simplify the work around the mast as much as possible with regard to assembling and disassembling the mast sections as well as bracing the mast to the adjacent building structure. While the work is usually carried out at relatively great heights, this would involve making the work around the mast and the adjacent building structure safer.

The object of the present invention is therefore to achieve a lift system of the type described in the introduction that is so constructed that the work carried out around the mast with regard to its erection and tearing down can be simplified and carried out in a manner that is safer for personnel. More precisely, the invention is aimed at simplifying the erection and tearing down of mast sections as well as simplify the application and removal of the stay elements between the building structure and the mast.

This object of the invention can be achieved with the present lift device being given the distinctive features and characteristics specified in claim 1.

Further distinctive features and advantages of the lift system according to the invention are given in the dependent claims.

Figure 2:
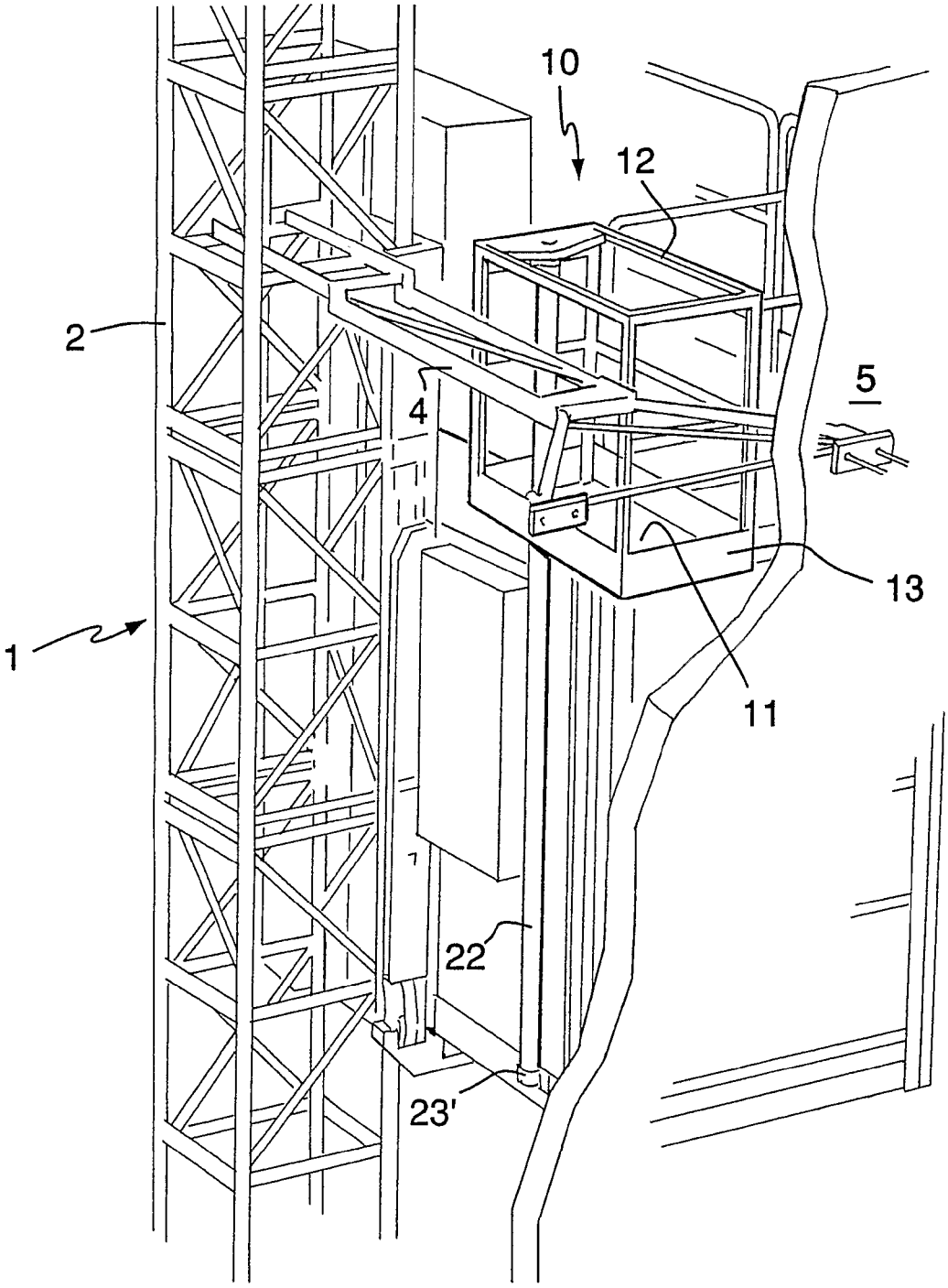
Figure 3:
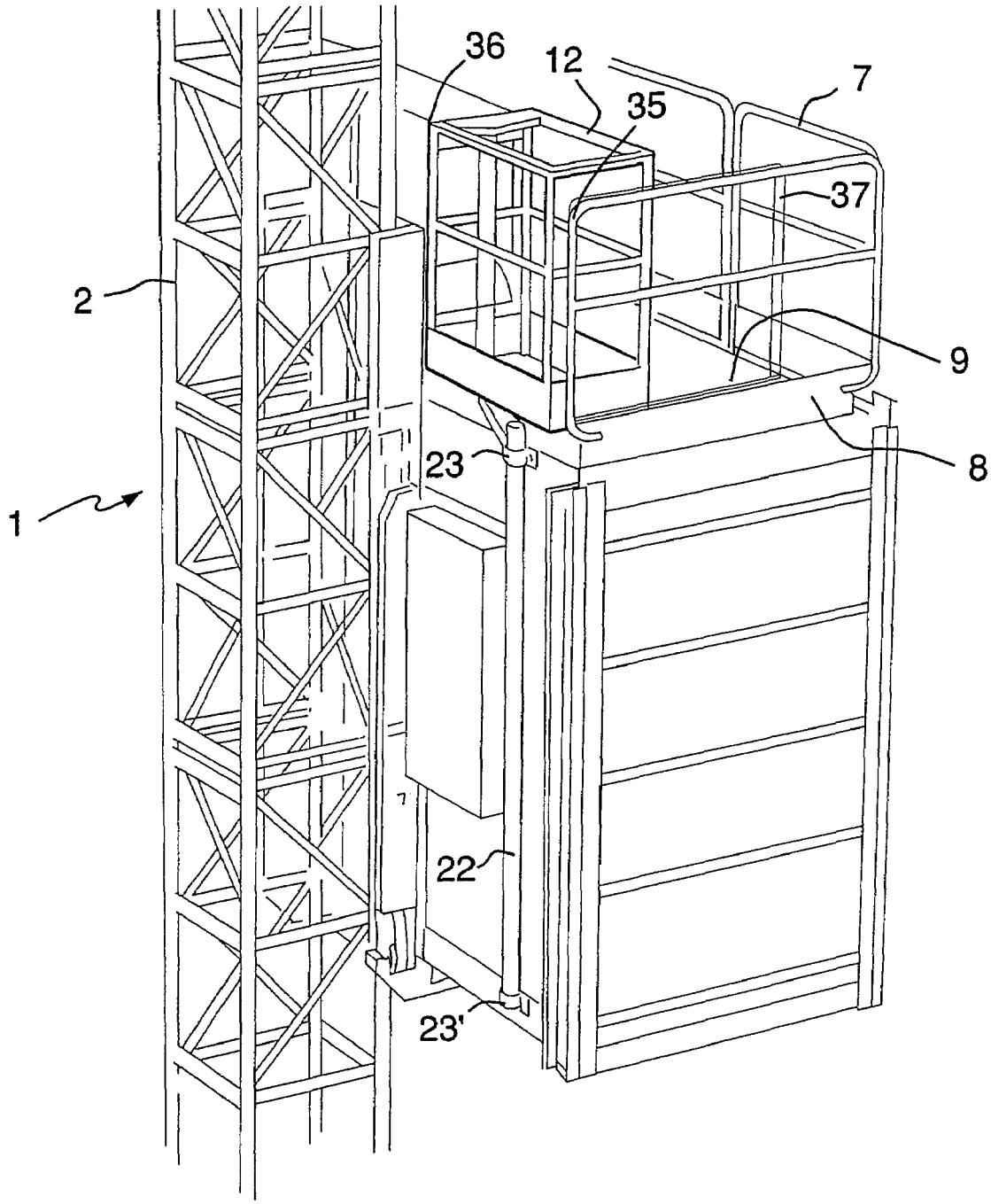
Figure 4:
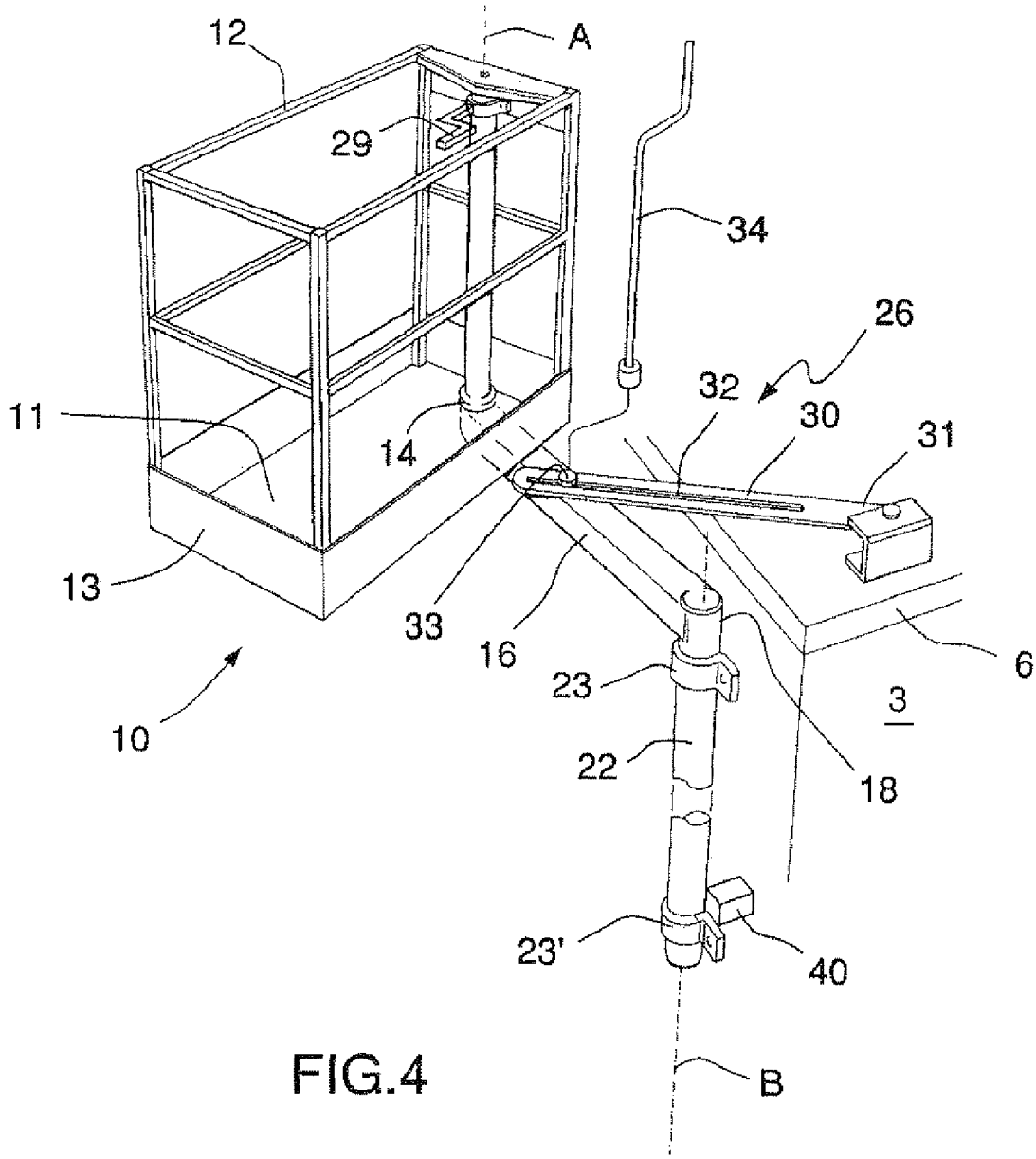
Figure 5:
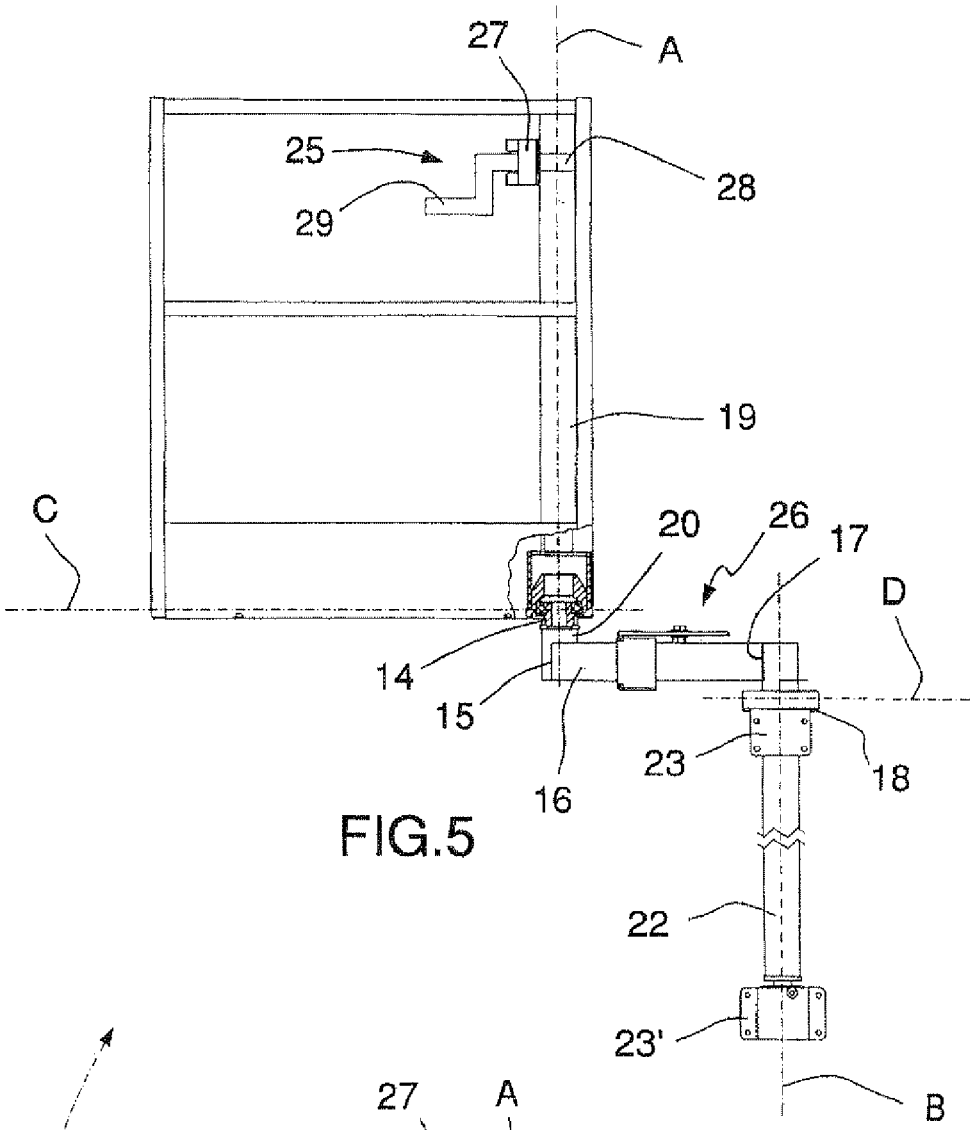
Figure 6:
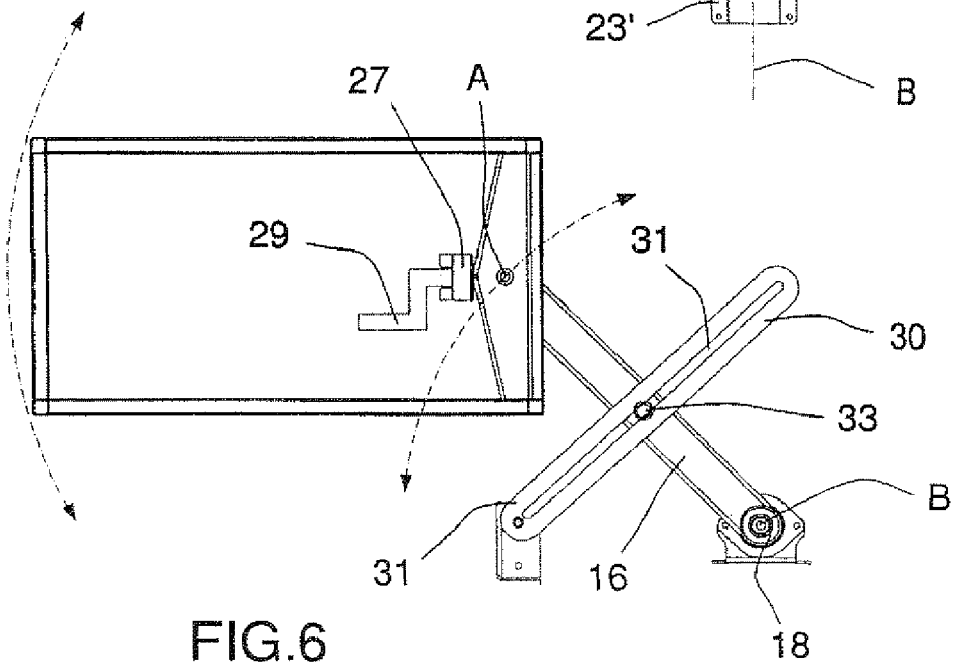
Figure 7:
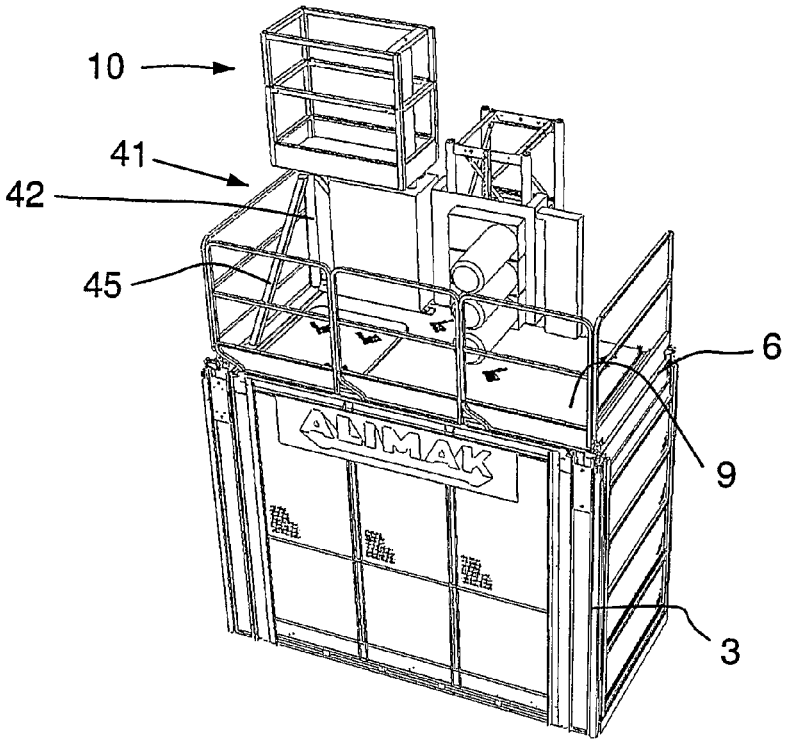
Figure 8:
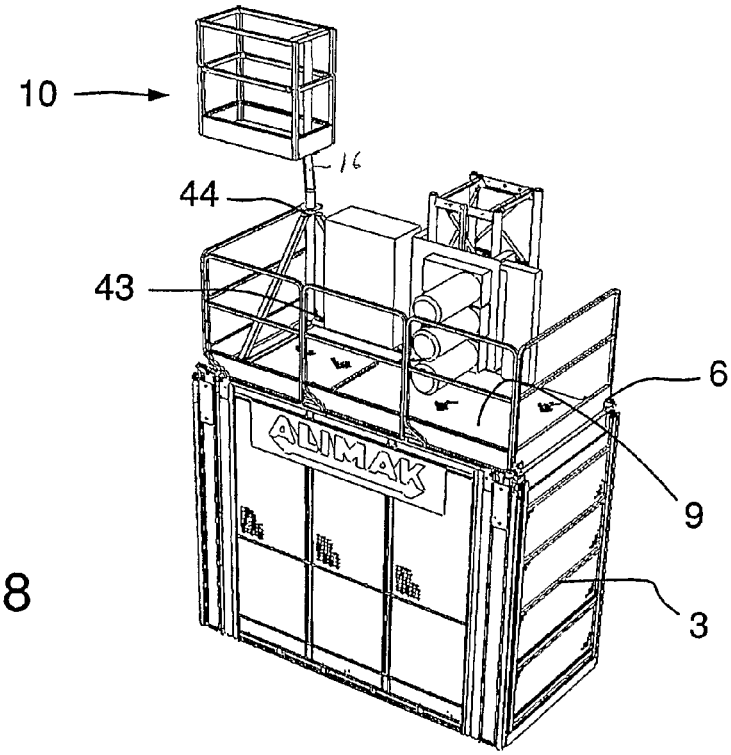
Figure 9:
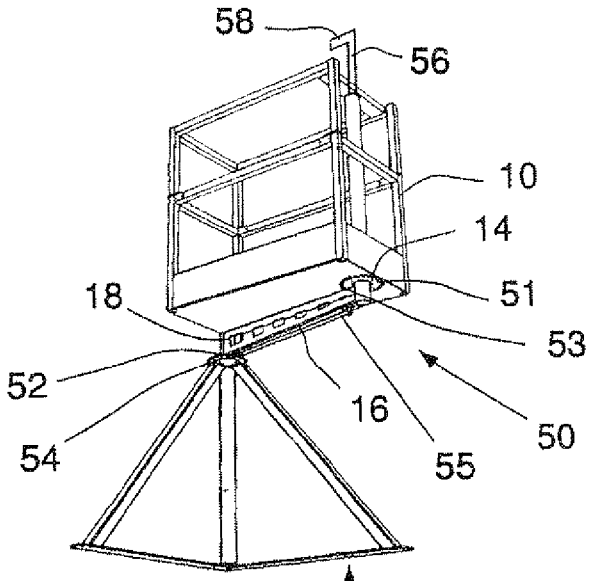
Figure 10:
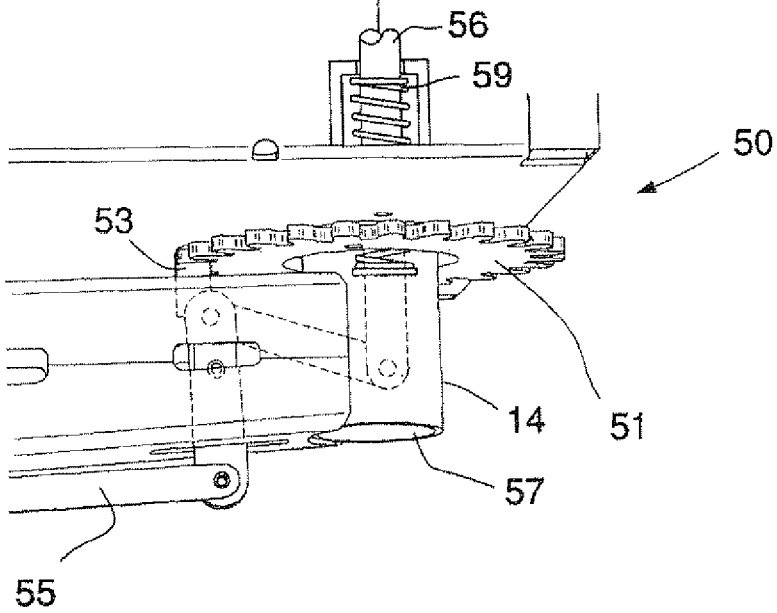
Figure 11:
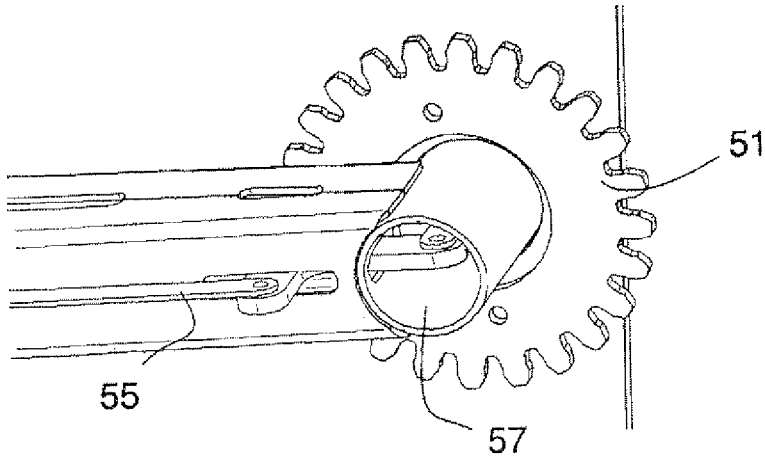

The following is a description of the invention with references to attached drawings, where FIG. 1 shows a perspective view of a lift system according to the invention, whereby a service and assembly platform supported by the lift car is swung into a working position adjacent to the mast along which the lift car runs, FIG. 2 shows a perspective view corresponding to FIG. 1 whereby the service and assembly platform supported by the lift car is swung into a working position in conjunction with the stay elements with which the mast is anchored to the nearby building structure, FIG. 3 shows a perspective view of the pivoting means of support used to carry the service and assembly platform and to which it is swung into a position of rest above an upper load bearing surface of the lift car, FIG. 4 shows a perspective view from above of the service and assembly platform in its swung-out position, FIG. 5 shows a side view partially in cross section of the service and assembly platform, FIG. 6 shows a view from above of the service and assembly platform swung-out in its normal working position, FIG. 7 shows a perspective view of a lift system according to the invention in an alternative embodiment whereby the service and assembly platform supported by the lift car is arranged at an essentially elevated level relative to the upper load bearing surface of the lift car, FIG. 8 shows a view corresponding to FIG. 7 whereby the service and assembly platform is in its swung-out working position, FIGS. 9-11 show partial views in perspective of a safety arrangement included in the lift system.

FIGS. 1-4 show a lift system according to the invention comprising a mast 1 constructed from a number of mast sections 2 stacked and mounted on top of each other and a lift car 3, which by means of guide rollers in a familiar manner can be moved along vertical tubes on the mast. The lift car 3 is furthermore in a familiar manner equipped with a motor that by means of a pinion engages with a gear rack on the mast 1. Even though the embodiment herein describes the principles for the lift system according to the invention applied to a covered lift car 3 of cage type, it should be understood that it can also be applied to the type of open lift car provided with only protective railings that is normally called a working platform. The expression lift car 3 as used in the following regards essentially known and existing car types for the carriage of people or goods that are used in lift systems where the mast 1 is constructed of a number of sections 2 mounted on top of each other and where the mast is intended via stay elements 4 to be anchored at regular intervals to a nearby building structure 5, which in FIG. 2 is indicated with a fragmented piece of a wall.

The roof of the cage type lift car 3 forms an upper working platform 6, which, on this type of lift car, is not normally used for carrying people and materials but is instead intended to be used for erecting the mast and for servicing. For reasons of safety, the said upper working platform 6 has both an upper essentially surrounding protective railing 7 and a lower surrounding protective edge 8 where the latter is used to prevent tools and the like that have been placed on the floor 9 of the working platform 6 from falling down. As described above, the upper working platform 6 is usually used as a load carrying surface for transporting mast sections 2 up and down from the top of the mast and as a working platform for personnel erecting and tearing down the mast sections. In the foregoing, it was stated that the upper working platform 6 is also used for bracing and anchoring the mast with stay elements 4 to the nearby building structure 5.

Thus far, the aforesaid can essentially be said to be known for this type of lift system and in order to achieve a lift system based on this that further improves accessibility when working on the mast and its erection, the lift car 3, as should be evident with a closer inspection of FIGS. 1-4, is equipped with a horizontally pivoted assembly and service platform, generally designated 10. The aforesaid pivoted assembly and service platform 10 has a principally rectangular and essentially level load bearing bottom 11, the area of which has been chosen to support at least one person assigned with the task of carrying out assembly and service work, such as cleaning or tearing down the mast 1 and anchoring or undoing the stay elements 4 between the mast 1 and the nearby building structure 5. Since the pivoted assembly and service platform 10 is intended to be used to support a person, it has been designed like a cage with surrounding protective railing 12 and also a surrounding protective edge 13 that abuts the bottom 11 of the platform for preventing tools or the like placed on the said bottom from falling down from the platform.

In order to be freely operated in an area principally limited by the mast 1 and the nearby building structure 5, the service and assembly platform 10 is pivot mounted in a first bearing 14 at one end 15 of a swing arm 16 so that it swings around a vertical axis A and via the other end 17 of the swing arm and a second bearing 18 is pivot mounted on the lift car 3 to carry out a pivoting motion around a vertical axis B. The swing motion of the assembly and service platform 10 in a horizontal plane is illustrated with the two double arrows in FIG. 5. The embodiment described herein has its first bearing 14 between one peripheral edge of the assembly and service platform 10, which here comprises one of its short ends, and the swing arm 16 by means of interaction between a swivel shaft 19 and swivel sleeve 20 while, from a loading point of view, the more critical second bearing 18 for the swing arm attachment to the lift car 3 is attained through interaction between a swivel shaft 22 extending along one side wall 21 of the cage type lift car 3 and a first and a second in-line swivel sleeve 23, 23'. As illustrated in FIG. 1, one of the swivel sleeves 23 is fixed to the roof that serves as a working platform 6 of the lift car 3 and the other swivel sleeve 20' is fixed to the floor 24 of the lift cage.

For locking and fixing the assembly and service platform 10 in predetermined positions, a first means of locking 25 has been arranged to lock the assembly and service platform 10 relative to the swing arm 16 and a second means of locking 26 for locking the swing arm 16 relative to the lift car 3. As illustrated in FIG. 6, the first means of locking 25 comprises a brake 27 and a set screw 28, which by means of a handle 29 can be driven to a braking position against the swivel shaft 19. The second means of locking 26 comprises an elongated flat iron 30 that is swivel mounted at one end 31 to the lift car 3 and with which a relative locking action between the swing arm 16 and the lift car 3 is obtained through the interaction between a slotted hole 32 running essentially along the length of the entire flat iron and a set screw 33 arranged in the swing arm and extending through the hole. As should be understood, by the application of the set screw 33 against the flat iron 25 by means of a removable spanner 34, the swing arm 16 can be locked in predetermined positions and thereby the swing arm 16 will also be fixed relative to the lift car 3. One advantage of this is that the first means of locking 25 and the second means of locking 26 can both be operated by personnel situated in the assembly and service platform 10.

Through the choice of embodiment, it should be understood that the assembly and service platform 10 can swivel freely within two separate horizontal planes that in FIG. 5 are designated C and D respectively, whereby the first horizontal plane C is defined by the first swivel bearing 14 and the second horizontal plane D is defined by the second swivel bearing 18. That is to say, in the area of the swing arm's 16 swivel connection with the assembly and service platform 10 and in the area of the swing arm's 16 swivel connection with the elevator car 3. Since the first horizontal swivel plane C between the service and assembly platform 10 and the swing arm 16 on the one hand and the second horizontal swivel plane D between the swing arm 16 and the elevator car 3 on the other hand are situated at different levels in height, it is possible swing the assembly and service platform 10 and the swing arm 16 freely in relation to each other. Thanks to the assembly and service platform 10 on one peripheral edge being flexibly connected to the swing arm 16, the swivel planes C and D being situated at different levels where the latter swivel plane B is also situated above the roof of the elevator car 3 that serves as an upper working platform 16, the assembly and service platform 10 as well as the swing arm 16 can be swung freely in relation to the said elevator car 3 working platform 6 and the position of rest shown in FIG. 3.

This hereby achieves the advantage that the swivelling assembly and service platform 10 can be moved to a position at which it extends relatively far out from the elevator car 3 in the direction of the adjacent building structure 6 as shown in FIG. 2. That is to say, to the service position that is normally difficult to access from the elevator car for fixing one end of the stay element 4 to the building structure 5. Through the free relative swivel action of the swinging parts 10, 16 where the assembly and service platform 10 at one peripheral edge is flexibly connected to the swing arm 16, the advantage is also achieved that the assembly and service platform 10 can be swung into an essentially folded position of rest in conjunction with the elevator car 3, whereby the assembly and service platform 10 is retracted in a position above the swing arm as shown in FIG. 2.

Through the double flexible connections of the assembly and service platform 10 to the elevator car 3 at both hinge points 14 and 18 respectively, the added advantage is achieved that the assembly and service platform 10 can be swung essentially around the mast 1 and consequently operated to the normally difficult to access service position at that part of the elevator mast, viewed from the elevator car 3, that constitutes the rear or the mast. Hereby, it is possible in both a safe and responsive manner to access the bolted joints between the mast sections 2 that are situated on the rear of the mast 1.

For receiving the assembly and service platform 10 when in its swung-in position, the surrounding protective railing 7 that this type of elevator car is fitted with has been modified somewhat. A closer look at FIG. 3 should reveal that the protective railing 7 has been modified in such a way that it has been divided and finished in a first 35 and a second end 36 that between them define an opening. The said opening is so adapted that the assembly and service platform 10 can be received in the opening when it is swung into its position of rest. The first 35 and second end 36 of the protective railing 7 like the assembly and service platform 10 have hereby been adapted in such a way that the swung-in assembly and service platform 10 forms part of the protective railing 7 and lower protective edge 8 surrounding the elevator car 3. In order to maintain the protective function of the protective railing 7 and protective edge 8 irrespective of the position of the assembly and service platform 10, there is a gate 37 swivel mounted on one free end of the protective railing 7 (see FIG. 1). This gate 37 is designed with both an upper rail 38 and a lower protective edge 39 and, as illustrated by the double arrow 40, it can be swung around a vertical axis E to a locking position at the second free end 36 of the protective railing 7 and secured by a means of locking 41 acting between these parts when the assembly and service platform 7 is in a position swung out from the elevator car 3.

From a safety point of view, it is furthermore essential that the elevator car 3 cannot be moved along the mast 1 while the assembly and service platform is in a swung-out operating position and in conjunction with on-going assembly and service work. For this purpose, a position sensing switch 40 has been arranged to detect when the assembly and service platform 7 is in an operating position swung out from the elevator car. The said switch 40 comprises a limit switch connected to the drive circuit for the elevator car 3 drive motor. The limit switch is so arranged to the swivel shaft 22 that it detects the relative angle of rotation of the shaft. In a case where the swivel shaft is swung away from a predetermined angle, the current to the elevator car 3 drive motor will be cut, thereby preventing the operation of the elevator car.

FIGS. 7 and 8 show the elevator system according to the invention in an alternative embodiment, which essentially differs from the first embodiment described above in that the assembly and service platform's 10 flexible connection with the elevator car 3 via the swing arm 16 is arranged at a level situated essentially above the roof serving as a working platform 6 above the elevator car 3 or the bottom surface 9. More precisely, the swivel bearing 18 for swinging the swing arm 16 relative to the elevator car 3 and thereby also for swinging the assembly and service platform 10 around the axis B relative to the elevator car is arranged at such a height above the elevator car's 3 working platform 6 that both swivel planes C and D, within which the assembly and service platform 10 can be swung freely, are above the protective railing 7 that runs around the periphery of the working platform. From the swung-in position of rest shown in FIG. 7, the assembly and service platform 10 can be swung freely both above the roof surface 9 of the elevator car 3 serving as a working platform 6 and out to a position at which it extends relatively far out from the elevator car 3 in a direction towards, for instance, an adjoining building structure for bracing the mast 1 with a stay element 4 or for relative attachment of the stacked mast sections 2.

For raising the swivel planes C and D of the assembly and service platform 10 essentially above the roof surface 9 of the working platform 6, a stand 41 is arranged in conjunction with one end of the elevator car. The stand 41 comprises a tubular swivel sleeve 42 that can be said to form a upward vertically extending extension of the swivel bearing for the arm 16 shown in FIG. 1. The swivel sleeve 42 in the stand 41 is at one end 43 attached to the bottom surface 9 of the working platform 6 and at its upper free second end 44 braced to the bottom surface 9 via stay elements 45 extending diagonally between the upper free second end of the swivel sleeve 42 and the bottom surface 9. The swivel sleeve 42 hereby serves as a bearing and receptacle for a swivel shaft that can essentially be said to correspond to the swivel shaft designated 22 in FIG. 1. The swivel bearing 18 for the swing arm's 16 flexible attachment to the elevator car 3 is hereby achieved through the interaction between the said swivel shaft 22 and swivel sleeve 42.

FIGS. 9-11 show an example of an arrangement that further improves safety when working on the assembly and service platform 10 and prevents inadvertent operation. In particular, the safety arrangement is used to prevent the assembly and service platform 10 from being inadvertently swung out from its parked position above the roof of the elevator car 3 that serves as a working platform 6, for example in case someone should lean against an assembly and service platform 10 when in parking position that has not been locked in place.

For this safety arrangement, as shown in FIG. 9, there is a blocking device 50 comprising a first gear ring 51 positioned in conjunction with the first bearing 14 between the swing arm 16 and the assembly and service platform 10, and a second gear ring 52 situated in conjunction with the second swivel bearing 18 between the swing arm 16 and elevator car 3. The blocking device also includes a pawl 53, 54 arranged to each of the gear rings 51, 52 that when engaged in their respective gear rings 51, 52 will block the respective swivel bearings 14, 18 and thereby also prevent the assembly and service platform from swinging relative to the elevator car 3. For clarity reasons and since the blocking function of each of the gear rings 51, 52 is identical, only one of them is described. The pawls 53, 54 are interlinked via a linkage system generally designated 55, which, via a shaft 56 extending through a central opening 57 in the first bearing 14 between the swing arm 16 and the assembly and service platform 10, is in connection with the operating handle 58 in the assembly and service platform 10 and with which operating handle the pawls can be operated. Arranged to the linkage system is a spring device 59 through the action of which the linkage system is loaded in such a way that the assembly and service platform cannot be operated or swung without an operator actively releasing the engagement of the pawls 53, 54, in the gear rings 51, 52 via the operating handle 58. The blocking device 50 is released by pulling the handle upwards as indicated by an arrow in FIG. 10. The risk of somebody falling off the roof of the elevator due to that person leaning against an unlocked assembly and service platform can thereby be eliminated.

By deepening the tooth gaps in the ring gear that correspond to the parking position and then in conjunction with these fit limit switches to the linkage system, it would be simple to monitor the assembly and service platform position and thereby cut the current to the elevator car drive machinery when the assembly and service platform 10 is swung out.

When erecting or tearing down a mast 1, the elevator car 3 is moved to the desired level along the mast. Hereafter, the first 25 and second means of locking 26 are returned to their unlocked positions so that the assembly and service platform 10 can be swung out freely from its position of rest above the upper platform 6 of the elevator car 3. As soon as the assembly and service platform 7 has left its position of rest at the elevator car 3 the gate 37 is swung out from its normal position to a locked position at the free end 36 of the protective railing 7, so forming a continuous surrounding protective railing as shown in FIG. 1.

Once the assembly and service platform 10 has been swung out to its desired position, the first 25 and second means of braking 26 will be switched to their respective active braking positions so that the assembly and service platform will remain in a fixed position relative to the elevator car. After completing the service or assembly work, the first 25 and second means of braking 26 will return to their respective non-braking positions, after which the assembly and service platform 7 is swung back to its position of rest at the elevator car once the gate 37 has been swung into its inactive normal position.

The present invention is not limited to the above description or as illustrated in the drawings but can be changed and modified in a number of different ways within the framework of the idea of invention specified in the following claims.

The invention claimed is:

1. Elevator system comprising an elevator car with a working platform arranged for carrying people or materials, an elongated generally vertical mast constructed from a number of mast sections mounted on top of each other along which the elevator car can be moved by means of the interaction between a gear wheel rotated by a drive motor and a gear rack running along the mast, a passenger carrying service and assembly platform that is designed as a cage with surrounding protective railing and that is so supported on the elevator car that it can be brought to move relative to the working platform between an inner position of rest and an outer working position at a distance from the working platform via a swing arm having a first end and a second end, wherein motion of the service and assembly platform in relation to the elevator car is obtained through a combination of (a) a first bearing that is pivotally connected to the service and assembly platform and the first end of the swing arm via a swivel shaft and a swivel sleeve and that allows the service and assembly platform to swing in a horizontal plane around a first vertical axis of the first bearing, and (b) a second bearing that is pivotally connected to the second end of the swing arm and the elevator car and that allows the swing arm to swing in a horizontal plane around a second vertical axis of the second bearing, wherein a first locking member comprising a handle operably connected to a brake may be driven to a braking position against the swivel shaft to lock the assembly and service platform; and wherein a second locking member operably configured to lock the service and assembly platform relative to the elevator car comprises a flat iron that is swivel mounted at one end of the elevator car and whereby a relative locking action between the swing arm and the elevator car is obtained via the action of a slotted hole running along the length of the entire flat iron and a set screw in the swing arm against the flat iron.

2. Elevator system according to claim 1, wherein the service and assembly platform supported by the swing arm is above the working platform when it is moved to its inner position of rest.

3. Elevator according to claim 1, wherein the service and assembly platform, via the first bearing and the second bearing, is free to swing within two vertically separated horizontal planes.

4. Elevator system according to claim 1, wherein the service and assembly platform is flexibly connected to the swing arm in conjunction with a lower edge of the service and assembly platform.

5. Elevator system according to claim 1, comprising a first means of locking for locking the swivel motion of the assembly and service platform relative to the swing arm and a second means of locking for locking the swivel motion of the swing arm relative to the elevator car.

6. Elevator system according to claim 1, comprising a position sensing switch that detects when the assembly and service platform is in its outer working position and in this position cuts the current to the elevator car's drive motor.

7. Elevator system according to claim 1, wherein the assembly and service platform has a lower surrounding protective edge running along the bottom surface of the service platform to prevent objects falling off the said bottom surface.

8. Elevator system according to claim 1, exhibiting a safety arrangement with a manually controlled blocking device, which, when in an unaffected position, prevents the assembly and service platform from moving relative to the elevator car.

9. Elevator system according to claim 1, wherein the elevator car working platform has a protective railing with a first and second end that between them limit an opening into which the assembly and service platform can be received when it is moved to its inner position of rest.

10. Elevator system according to claim 1, wherein the elevator car working platform is equipped with an upper surrounding protective railing and the horizontal planes within which the service and assembly platform can be swung are arranged at such levels above the protective railing that the service and assembly platform can be swung in over the said protective railing.

11. Elevator system according to claim 1, wherein the first vertical axis is positioned adjacent an end of the service and assembly platform.

12. Elevator system according to claim 4, wherein the service and assembly platform as viewed from above is primarily rectangular and that the flexible connection with the swing arm is arranged at one short end of the primarily rectangular service and assembly platform.

13. Elevator system according to claim 6, wherein the position sensing switch comprises a limit switch that when connected to the drive circuit of the elevator car drive motor senses a turning angle of the swing arm around the vertical axis relative to the elevator car.

14. Elevator system according to claim 8, wherein the blocking device when unaffected is arranged to take an active locking position under the influence of a spring.

15. Elevator system according to claim 14, wherein the blocking device included in the safety arrangement comprises a system of interacting gear rings and pawls plus a linkage system with a handle for operating the pawls to engage and disengage from the gear rings where the pawls, when engaged with the gears, stop the assembly and service platform from swinging relative to the elevator car and in which the pawls are disengaged from the gears in a direction opposing the force of the spring.

16. Elevator system according to claim 9, wherein a gate is arranged to the said one end of the protective railing and can be swung into a locked position in a means of locking arranged on the second end of the protective railing when the assembly and service platform is in its outer working position.

17. Elevator system according to claim 10, wherein the service and assembly platform is flexibly connected to the elevator car at the second bearing wherein the second bearing is arranged at an upper end of a stand fastened to the elevator car working platform.

* * * * *